US009380879B2

(12) United States Patent
Hector et al.

(10) Patent No.: US 9,380,879 B2
(45) Date of Patent: Jul. 5, 2016

(54) CHAIR BACK SWIVEL MECHANISM

(71) Applicant: Knoll, Inc., East Greenville, PA (US)

(72) Inventors: Andrew Hector, Red Hill, PA (US); Khalid Masoud, Souderton, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 14/611,498

(22) Filed: Feb. 2, 2015

(65) Prior Publication Data

US 2015/0238015 A1 Aug. 27, 2015

Related U.S. Application Data

(60) Provisional application No. 61/943,560, filed on Feb. 24, 2014.

(51) Int. Cl.

| | |
|---|---|
| ***A47C 3/00*** | (2006.01) |
| ***B60N 2/02*** | (2006.01) |
| ***A47C 7/40*** | (2006.01) |
| ***A47C 7/48*** | (2006.01) |
| *A47C 1/032* | (2006.01) |
| *A47C 1/034* | (2006.01) |

(52) U.S. Cl.

CPC ... *A47C 7/40* (2013.01); *A47C 3/00* (2013.01); *A47C 7/48* (2013.01); *A47C 1/032* (2013.01); *A47C 1/034* (2013.01); *A47C 1/03255* (2013.01); *A47C 1/03261* (2013.01); *A47C 1/03266* (2013.01); *A47C 1/03272* (2013.01)

(58) Field of Classification Search

CPC .... A47C 1/032; A47C 1/024; A47C 1/03255; A47C 1/03272; A47C 1/03266; A47C 1/03261

USPC ..... 297/285, 300.5, 300.2, 353, 303.4, 297/361.1, 364, 365, 374, 376

See application file for complete search history.

(56) References Cited

U.S. PATENT DOCUMENTS

| | | | |
|---|---|---|---|
| 2,650,648 | A | 9/1953 | Nordmark et al. |
| 3,042,448 | A | 7/1962 | Hamilton |

(Continued)

FOREIGN PATENT DOCUMENTS

| | | |
|---|---|---|
| JP | 2009131357 | 6/2009 |
| JP | 2009131357 A | 6/2009 |

OTHER PUBLICATIONS

International Search Report dated for PCT/US2015/015194 dated Jun. 15, 2015.

(Continued)

*Primary Examiner* — Chi Q Nguyen

(74) *Attorney, Agent, or Firm* — Buchanan Ingersoll & Rooney PC

(57) ABSTRACT

A chair includes a backrest swivel mechanism that is configured to permit the backrest to swivel about a vertical axis about a preselected range of motion. The backrest may be configured to swivel, or rotate, about a vertical axis that is defined by an element located adjacent a rearward central location that is below the seat of the chair and adjacent a rear of the chair. A lock mechanism can be selectively engaged to lock and unlock the swiveling mechanism so that when in the locked state, the backrest cannot swivel and when in the unlocked state, the backrest can swivel. In some embodiments, the range of swiveling motion may be with a predefined range, such as +/−10° or +/−20° of rotation relative to a central position of the backrest.

19 Claims, 7 Drawing Sheets

(56) References Cited

U.S. PATENT DOCUMENTS

| | | | | | |
|---|---|---|---|---|---|
| 3,055,628 | A | | 9/1962 | Savage | |
| 3,863,982 | A | | 2/1975 | Sandham | |
| 3,905,642 | A | | 9/1975 | Simjian | |
| 3,910,633 | A | | 10/1975 | Marsh | |
| 4,219,233 | A | | 8/1980 | Rodgers | |
| 4,235,408 | A | | 11/1980 | Sapper | |
| 4,380,352 | A | | 4/1983 | Diffrient | |
| 5,348,372 | A | * | 9/1994 | Takamatsu | A47C 1/0325 297/301.1 |
| 5,582,459 | A | * | 12/1996 | Hama | A47C 1/03255 297/285 |
| 5,695,250 | A | | 12/1997 | Lin | |
| 5,725,277 | A | | 3/1998 | Knoblock | |
| 5,755,490 | A | | 5/1998 | Lamart | |
| 5,765,804 | A | * | 6/1998 | Stumpf | A47C 1/03 248/161 |
| 5,909,924 | A | * | 6/1999 | Roslund, Jr. | A47C 1/03255 297/300.4 |
| 6,048,029 | A | | 4/2000 | Percoco | |
| 6,086,153 | A | | 7/2000 | Heidmann et al. | |
| 6,250,715 | B1 | * | 6/2001 | Caruso | A47C 1/03 297/300.2 |
| 6,367,876 | B2 | | 4/2002 | Caruso et al. | |
| 6,439,661 | B1 | * | 8/2002 | Brauning | A47C 1/023 297/300.2 |
| 6,598,937 | B2 | | 7/2003 | Caruso et al. | |
| 6,733,080 | B2 | | 5/2004 | Stumpf et al. | |
| 6,817,667 | B2 | | 11/2004 | Pennington et al. | |
| 6,869,142 | B2 | | 3/2005 | Heidmann et al. | |
| 6,932,430 | B2 | | 8/2005 | Bedford et al. | |
| 7,293,833 | B2 | * | 11/2007 | Takeuchi | A47C 3/026 297/301.4 |
| 7,547,067 | B2 | | 6/2009 | Keilhauer et al. | |
| 8,002,351 | B2 | | 8/2011 | Golynsky | |
| 8,282,172 | B2 | | 10/2012 | Schmitz et al. | |
| 8,348,342 | B2 | | 1/2013 | Golynsky et al. | |
| 8,419,133 | B2 | | 4/2013 | Holt et al. | |
| 8,469,454 | B2 | | 6/2013 | Holt et al. | |
| 8,480,171 | B2 | | 7/2013 | Chadwick et al. | |

OTHER PUBLICATIONS

Written Opinion of the International Searching Authority for PCT/US2015/015194 dated Jun. 15, 2015.

Notification of Transmittal of the International Search Report and Written Opinion of the International Searching Authority, International Search Report and Written Opinion of the International Searching Authority for PCT/US2015/015194, mailed Jun. 15, 2015 (15 pages).

* cited by examiner

CHAIR BACK SWIVEL MECHANISM

CROSS-REFERENCE TO RELATED APPLICATIONS

The present application claims priority to U.S. Provisional Patent Application No. 61/943,560, which was filed on Feb. 24, 2014.

FIELD OF INVENTION

The present invention relates to chairs. More particularly, to a chair back swivel mechanism configured to permit a chair back to swivel about a vertical axis.

BACKGROUND OF THE INVENTION

Chairs often include backrests, or a chair back. A backrest may be stationary or may be reclinable. Some office chairs or other chairs may also include a seat that is rotatable. When the chair seat rotates, the back may also rotate with the seat due to the back's connection to the seat. Examples of chairs that include chair backs can be appreciated from U.S. Pat. Nos. 8,480,171, 8,469,454, 8,419,133, 8,348,342, 8,282,172, 8,002,351, 7,547,067, 6,932,430, 6,869,142, 6,817,667, 6,733,080, 6,598,937, 6,367,876, 6,086,153, 6,048,029, 5,755,490, 5,725,277, 4,380,352, 4,235,408, 4,219,233, 3,910,633, 3,863,982, 3,055,628, 3,042,448, and 2,650,648.

SUMMARY OF THE INVENTION

A chair can include a seat, a base that supports the seat, and a backrest. The backrest can be connected to at least one of the base and the seat via a backrest connection mechanism. The backrest connection mechanism can comprise a backrest swivel mechanism that facilitates swiveling of the backrest relative to the seat such that the backrest is rotatable about at least one vertical axis from a centered position to a plurality of swiveled positions.

In some embodiments, the swiveled positions can comprise a first swivel position and a second swivel position. The backrest can be in the first swivel position after being rotated toward a first side of the chair about the at least one vertical axis by at least 5° and the backrest can be in the second swivel position after being rotated toward a second side of the chair that is opposite the first side of the chair about the at least one vertical axis by at least 5°. The chair can have a front and a rear and the first and second sides of the chair can be left and right sides of the chair.

In some embodiments, the backrest swivel mechanism can include a first boss that is received within a first opening of a bottom portion of the backrest, a second boss that is received within a slot of the bottom portion of the backrest, and the at least one vertical axis can include a first vertical axis that is defined by the first boss. The slot can be elongated and arcuate in shape to define a path of rotation of the backrest about the first vertical axis between the first swivel position and the second swivel position. The second boss can contact or otherwise engage a portion of the bottom portion of the backrest adjacent a first end of the slot when the backrest is swiveled to the first swiveled position about the first vertical axis and the second boss can contact or otherwise engage a portion of the bottom portion of the backrest adjacent a second end of the slot when the backrest is swiveled to the second swiveled position. The second end of the slot can be at an end of the slot that is opposite the first end of the slot. The path of rotation defined by the slot can be configured to limit swiveling of the backrest relative to the seat about the first vertical axis to +/−40°, +/−20° or +/−10° relative to a centered position of the backrest. The centered position of the backrest can be the initial position of the backrest. The backrest swivel mechanism can be configured to bias the backrest in this centered position.

The backrest swivel mechanism can also comprise a first spring having a first end attached to a connection member of the backrest swivel mechanism and a second end attached to the bottom portion of the backrest and a second spring having a first end attached to the connection member and a second end attached to the bottom portion of the backrest. The first boss can be attached to the connection member and be positioned between the first and second springs. The second boss can also be attached to the connection member and can also be positioned between the first and second springs. The connection member can be attached to at least one of the seat and the base.

The backrest can be comprised of a frame. The bottom portion of the backrest can be the bottom portion of the frame of the backrest. In other embodiments, the bottom portion of the backrest can be a bottom connector element of the bottom portion of the backrest that is configured for connecting the backrest to the backrest swivel mechanism. The base of the chair can be configured as a pedestal base, can be configured as a stand, or can be configured as a plurality of legs. The base can also include a tilt mechanism that is configured to facilitate tilting of the backrest and or the seat about at least one horizontal axis. The base can also include a height adjustment mechanism, such as a gas spring assembly that is configured to be actuated to raise and lower the seat and backrest.

A locking device can also be connected to the backrest swivel mechanism. The locking device can be moveable from a locking position that prevents swiveling of the backrest to an unlocked position. The backrest can be swivelable relative to the seat when the locking device is in the unlocked position. The locking device can comprise a detent that is moveable from an extended locking position to a retracted unlocked position. The detent can be positioned within a recess of the bottom portion of the backrest to engage the bottom portion of the backrest and prevent swiveling of the backrest when in the extended locking position. The detent can be retracted out of the recess of the bottom portion of the backrest when in the retracted unlocked position. A detent moving member can have a hole. A portion of the detent can pass through the hole of the detent moving member. A spring can contact or otherwise engage the detent to bias the detent to the extended locking position. For instance, the spring may contact one side of a portion of the detent mechanism and the detent moving member may contact an opposite second side of that first portion of the detent mechanism. A second portion of the detent may extend from the first portion to be passable through the hole of the detent moving member. The detent moving member can be configured to contact a portion of the detent to drive movement of the detent from the extended locking position to the retracted unlocked position when the locking device is moved to the unlocked position and the spring can be positioned and configured to drive movement of the detent through the hole of the detent moving member to the extended locking position when the locking device is moved to the locking position. The detent moving member can be moveable about a pivot point from a first position to a second position. The detent moving member can retract the detent to the retracted unlocked position when the detent moving member is moved to the second position.

A backrest swivel mechanism for a chair is also provided. In some embodiments, the backrest swivel mechanism can include a connection member for attaching to at least one of a seat of a chair and a base of the chair and a first boss attached to the connection member. The first boss is sized to be received within a first opening of a bottom portion of a backrest of the chair to define a first vertical axis about which the backrest is rotatable when attached to the backrest swivel mechanism. A second boss is also attached to the connection member. The second boss is sized to be received within a slot of the bottom portion of the backrest.

The backrest swivel mechanism can include a connection member for attaching to at least one of a seat of a chair and a base of the chair. A first boss can be attached to the connection member. The first boss can be sized to be received within a first opening of a bottom portion of a backrest of the chair to define a first vertical axis about which the backrest is rotatable when attached to the backrest swivel mechanism. A second boss can be attached to the connection member. The second boss can be sized to be received within a slot of the bottom portion of the backrest. The second boss can be sized such that the backrest is moveable along a path defined by the slot. The second boss can be sized to contact or otherwise engage a portion of the bottom portion of the backrest adjacent a first end of the slot when the backrest is swiveled to a first swiveled position about the first vertical axis and the second boss can be sized to contact or otherwise engage a portion of the bottom portion of the backrest adjacent a second end of the slot when the backrest is swiveled to a second swiveled position. The second end of the slot can be opposite the first end of the slot.

The backrest swivel mechanism can also include a first spring having a first end attached to the connection member and a second end attachable to the bottom portion of the backrest and a second spring having a first end attached to the connection member and a second end attached to the bottom portion of the backrest. The first boss can be positioned between the first and second springs and the second boss can also be attached to the connection member and so that it is positioned between the first and second springs.

A locking device can be connected to the connection member of the backrest swivel mechanism. The locking device can be moveable from a locking position that prevents swiveling of the backrest to an unlocked position. The backrest can be swivelable relative to the seat when the locking device is in the unlocked position. A detent moving member having a hole can also be included in the locking device. A portion of the detent can be sized to pass through the hole of the detent moving member. A spring can be positioned to contact or otherwise engage the detent to bias the detent to the extended locking position. The detent moving member can be positioned to contact a portion of the detent to drive movement of the detent from the extended locking position to the retracted unlocked position when the locking device is moved to the unlocked position and the spring can drive movement of a portion of the detent through the hole of the detent moving member to the extended locking position when the locking device is moved to the locking position. The detent moving member can be moveable about a pivot point from a first position to a second position. The detent moving member can retract the detent to the retracted unlocked position when the detent moving member is moved to the second position.

In some embodiments of the chair and backrest connection mechanism, the backrest connection mechanism can include a backrest swivel mechanism that facilitates swiveling of a backrest relative to a seat such that the backrest is rotatable about at least one vertical axis from a centered position to a plurality of swiveled positions. The backrest swivel mechanism can include a first boss that is received within a first opening of a bottom portion of the backrest, a portion of the seat, or a portion of the base where the first boss defines the first vertical axis. A second boss can be received within a slot of the bottom portion of the backrest, the portion of the seat, or the portion of the base. The slot can be elongated and arcuate in shape to define a path of rotation of the backrest about the first vertical axis between the first swivel position and the second swivel position. The second boss can contact or otherwise engage structure adjacent a first end of the slot when the backrest is swiveled to the first swiveled position and the second boss can contact or otherwise engage structure adjacent a second end of the slot when the backrest is swiveled to the second swiveled position. The second end of the slot can be opposite the first end of the slot.

In some embodiments, the bottom portion of the backrest, the portion of the seat, or the portion of the base can have both the opening for receiving the first boss and the slot for receiving the second boss. In yet other embodiments, the bottom portion of the backrest can have only one of the opening for receiving the first boss and the slot for receiving the second boss. For those embodiments, the portion of the seat or the portion of the base can have the other one of the opening for the first boss and the slot for receiving the second boss.

The bottom portion of the backrest having at least one of the opening for receiving the first boss and the slot for receiving the second boss can be a portion of the frame of the backrest or a portion of a connection mechanism for connecting the backrest to the seat or base of the chair. The portion of the seat having at least one of the opening and slot can be a portion of the seat frame. The portion of the base having at least one of the opening and slot can be a portion of a housing of the base for a tilt mechanism, knock down mechanism, or for receiving a portion of a gas spring. In other embodiments, the portion of the base having at least one of the opening and slot can be a housing or connection structure that is configured to facilitate connection of the backrest to the base and/or the seat for being supported by legs, a pedestal, a stand, or other support structure configured to support the chair on a floor.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a chair and backrest swivel mechanism are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Figure 1:
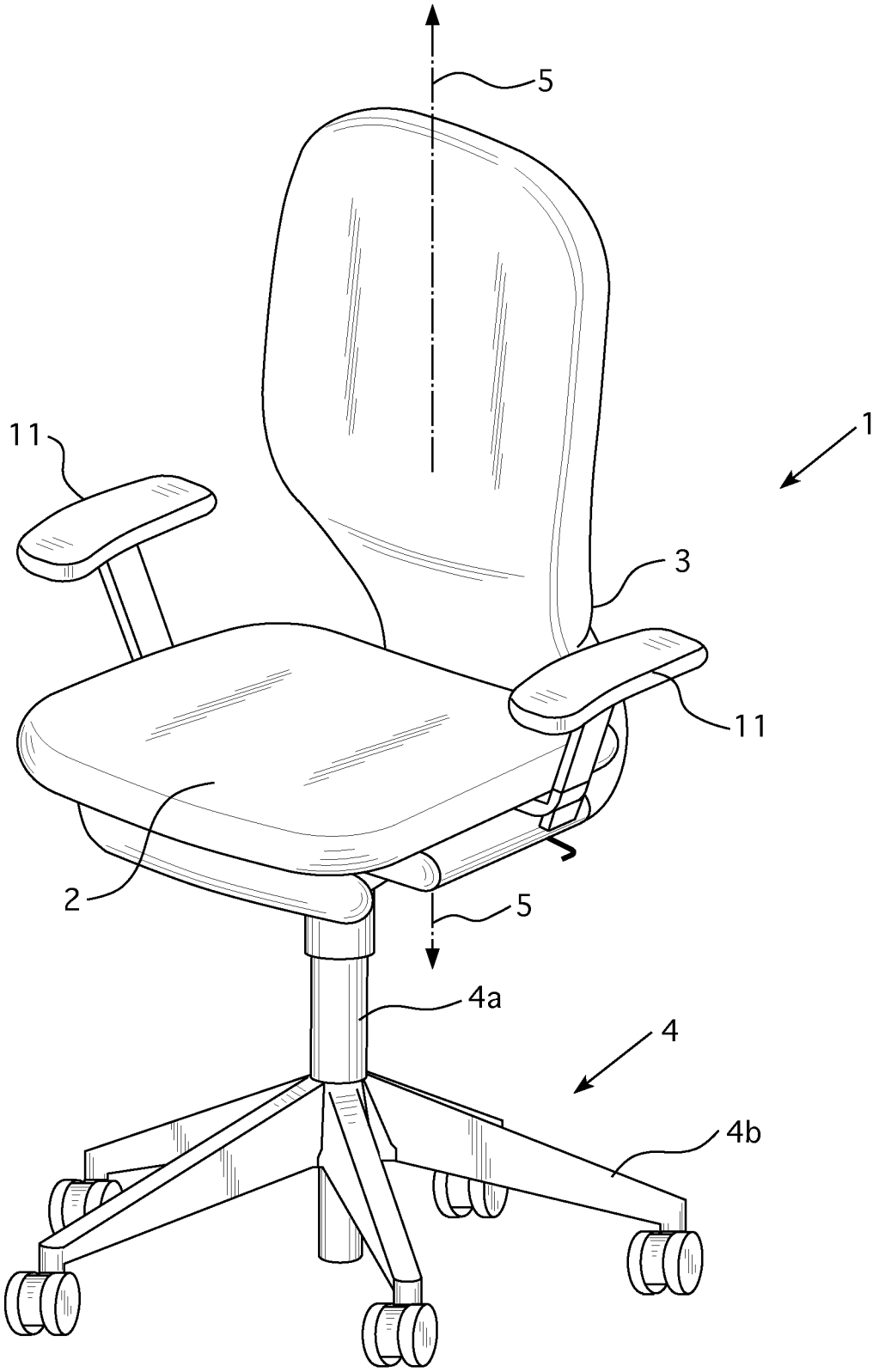
FIG. 1 is a perspective view of a first exemplary embodiment of a chair having a first exemplary embodiment of a backrest swivel mechanism. The backrest of the chair is in a non-swiveled, central position in FIG. 1.
Figure 2:
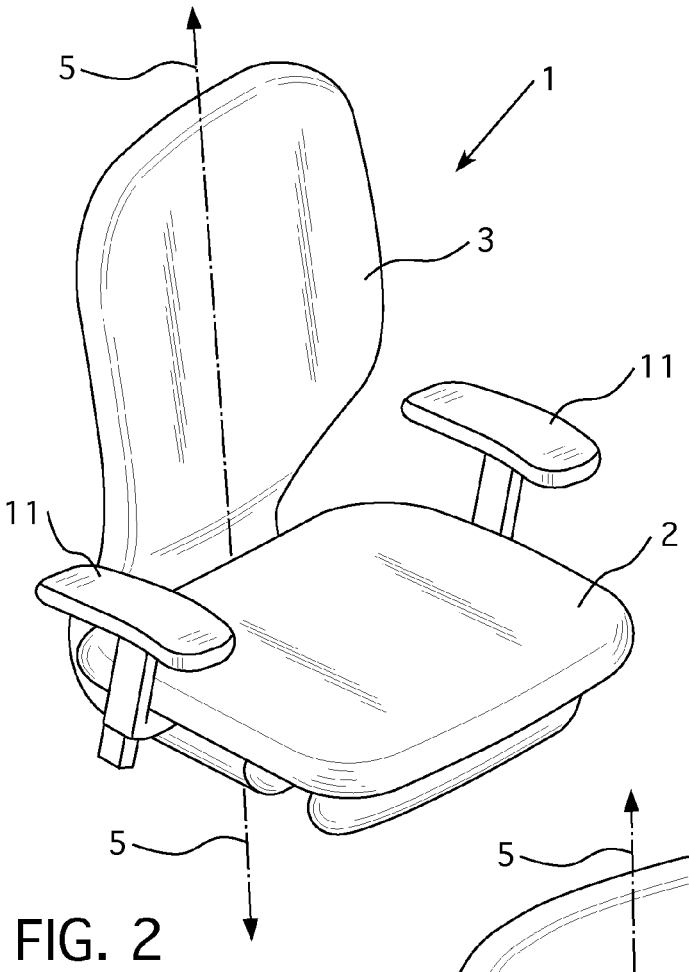
FIG. 2 is a perspective view of the first exemplary embodiment of the chair having the first exemplary embodiment of a backrest swivel mechanism where the backrest is swiveled in a first direction to a first swiveled position.
Figure 3:
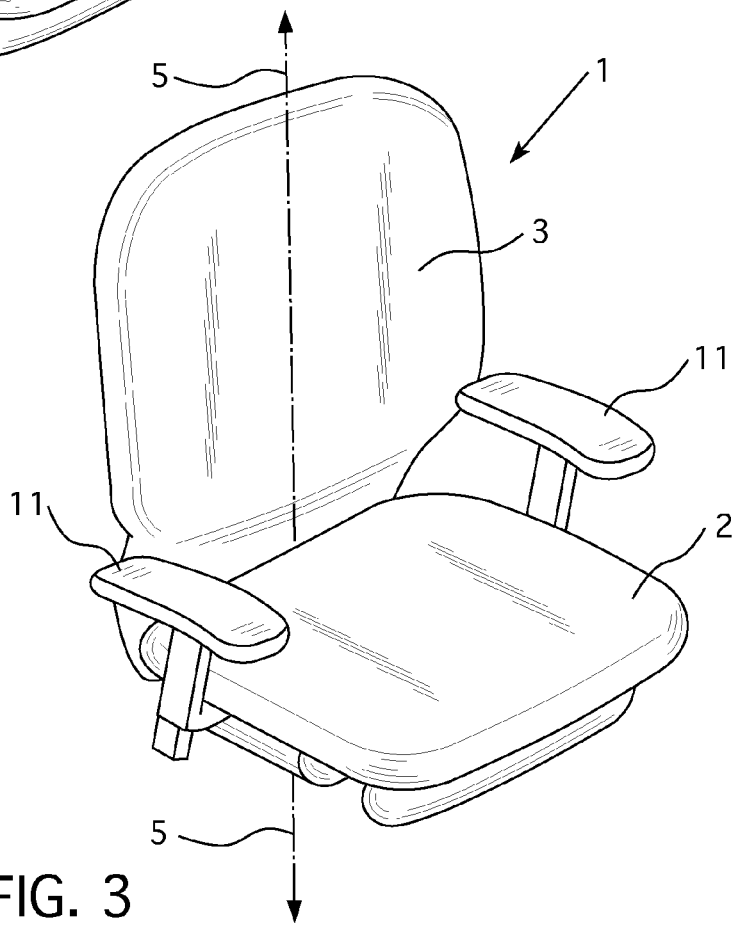
FIG. 3 is a perspective view of the first exemplary embodiment of the chair having the first exemplary embodiment of a backrest swivel mechanism where the backrest is swiveled in a second direction that is opposite the first direction to a second swiveled position.
Figure 4:
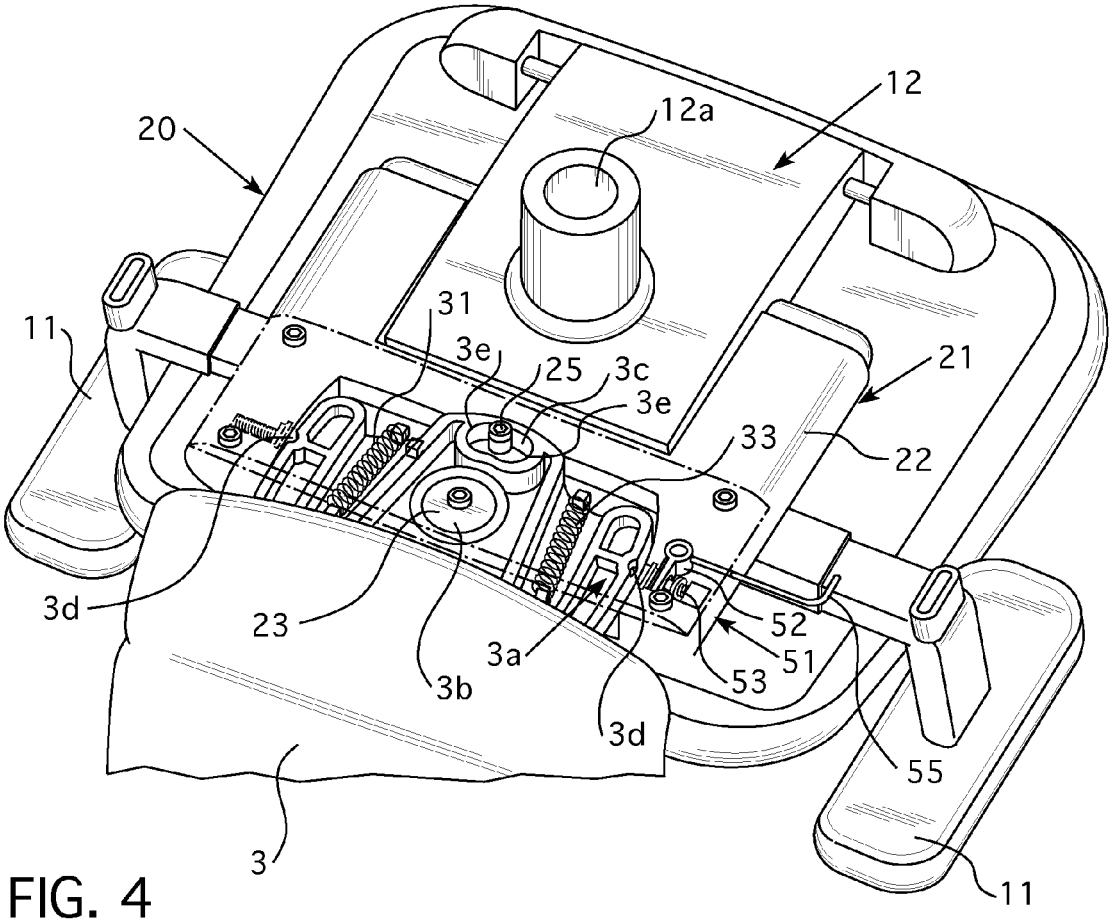
FIG. 4 is a bottom perspective view of the first exemplary embodiment of the chair having the first exemplary embodiment of a backrest swivel mechanism with the pedestal of the chair cut away.
Figure 5:
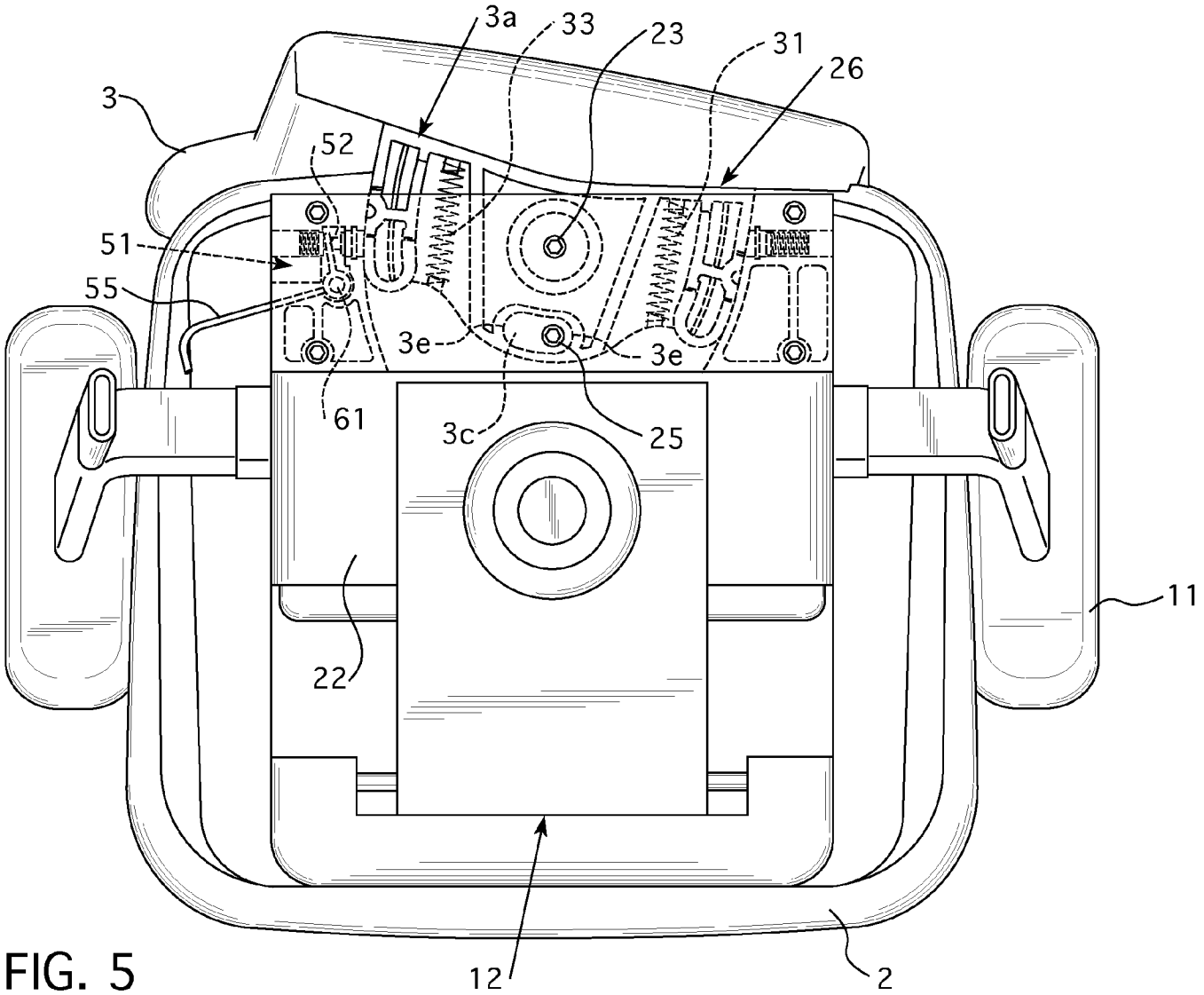
FIG. 5 is a bottom perspective view of the first exemplary embodiment of the chair having the first exemplary embodiment of a backrest swivel mechanism similar to the view of FIG. 4 with the backrest shown in the first swiveled position.
Figure 6:
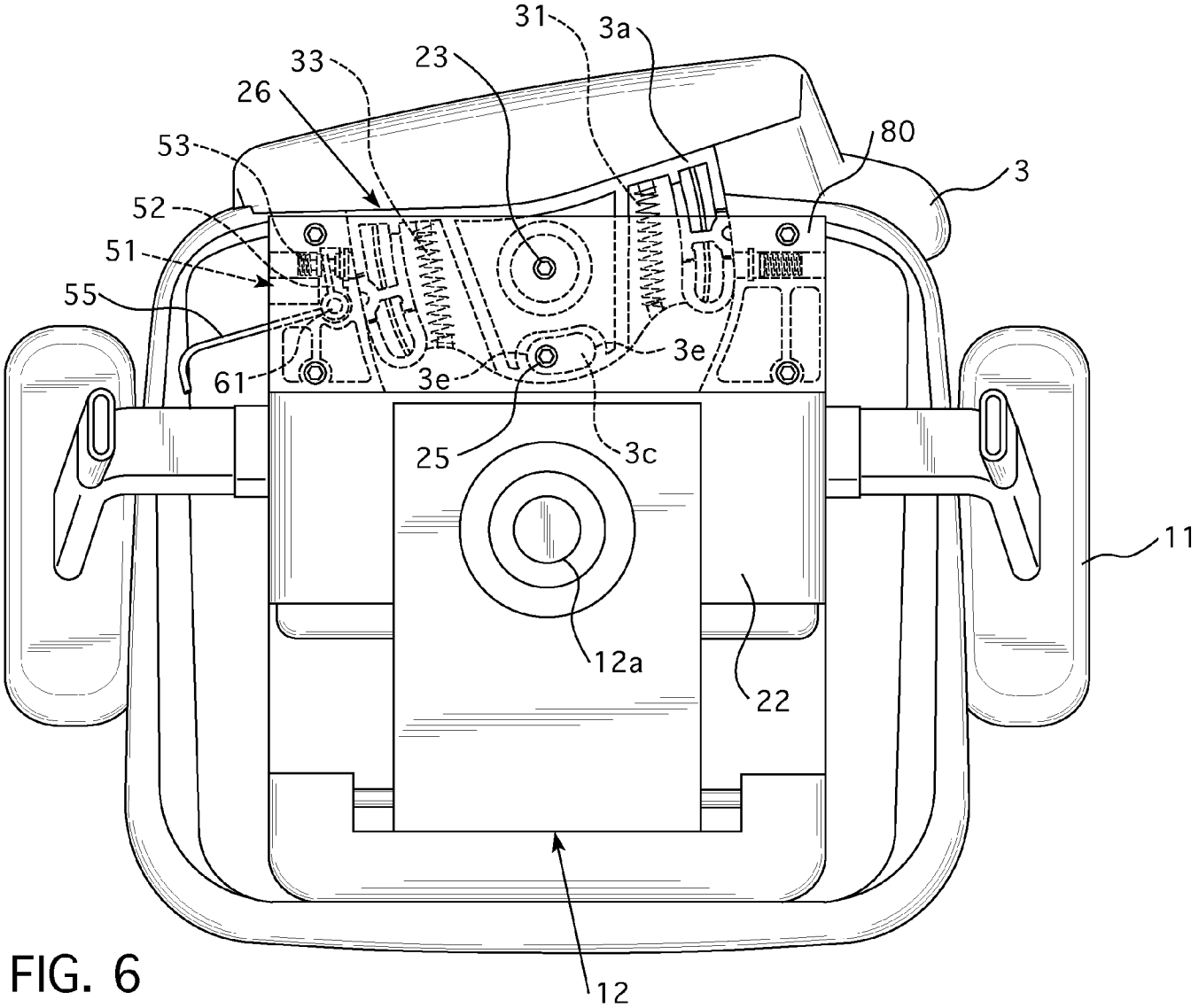
FIG. 6 is a bottom perspective view of the first exemplary embodiment of the chair having the first exemplary embodiment of a backrest swivel mechanism similar to the view of FIGS. 4 and 5 with the backrest shown in the second swiveled position.
Figure 7:
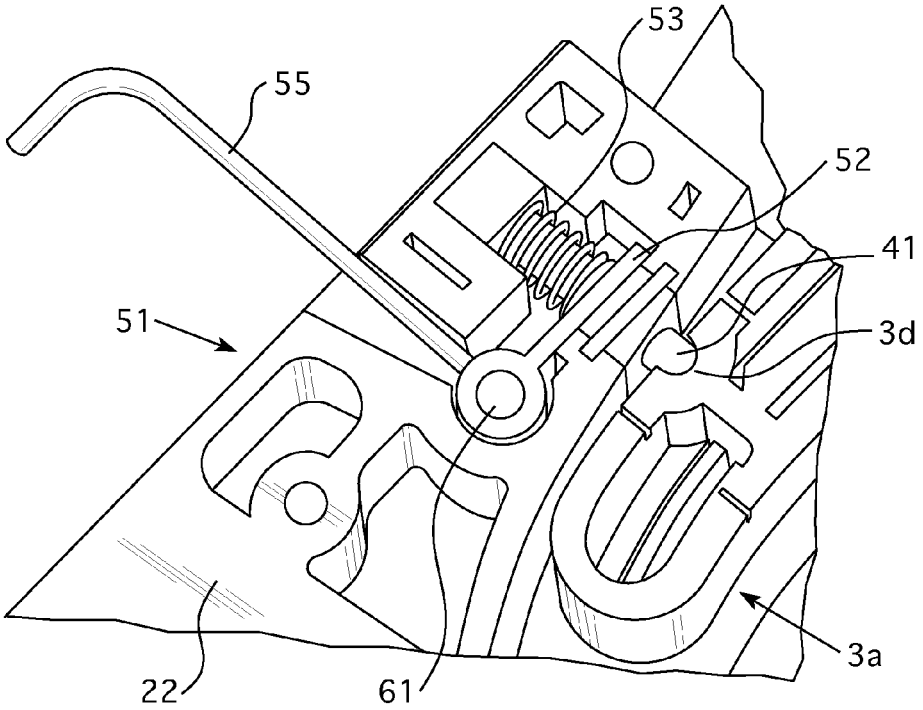
FIG. 7 is an enlarged fragmentary view of the first exemplary embodiment of the backrest swivel mechanism included in the first exemplary embodiment of the chair illustrating a locking device in a locked position.
Figure 8:
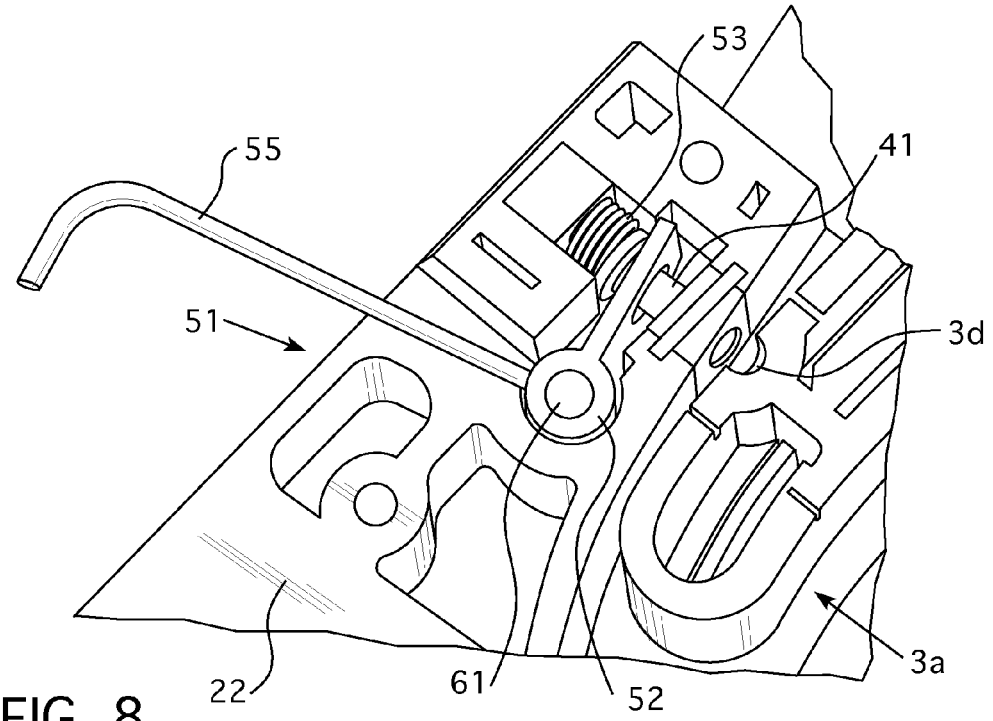
FIG. 8 is an enlarged fragmentary view of the first exemplary embodiment of the backrest swivel mechanism included in the first exemplary embodiment of the chair similar to FIG. 7 illustrating the locking device in an unlocked position.
Figure 9:
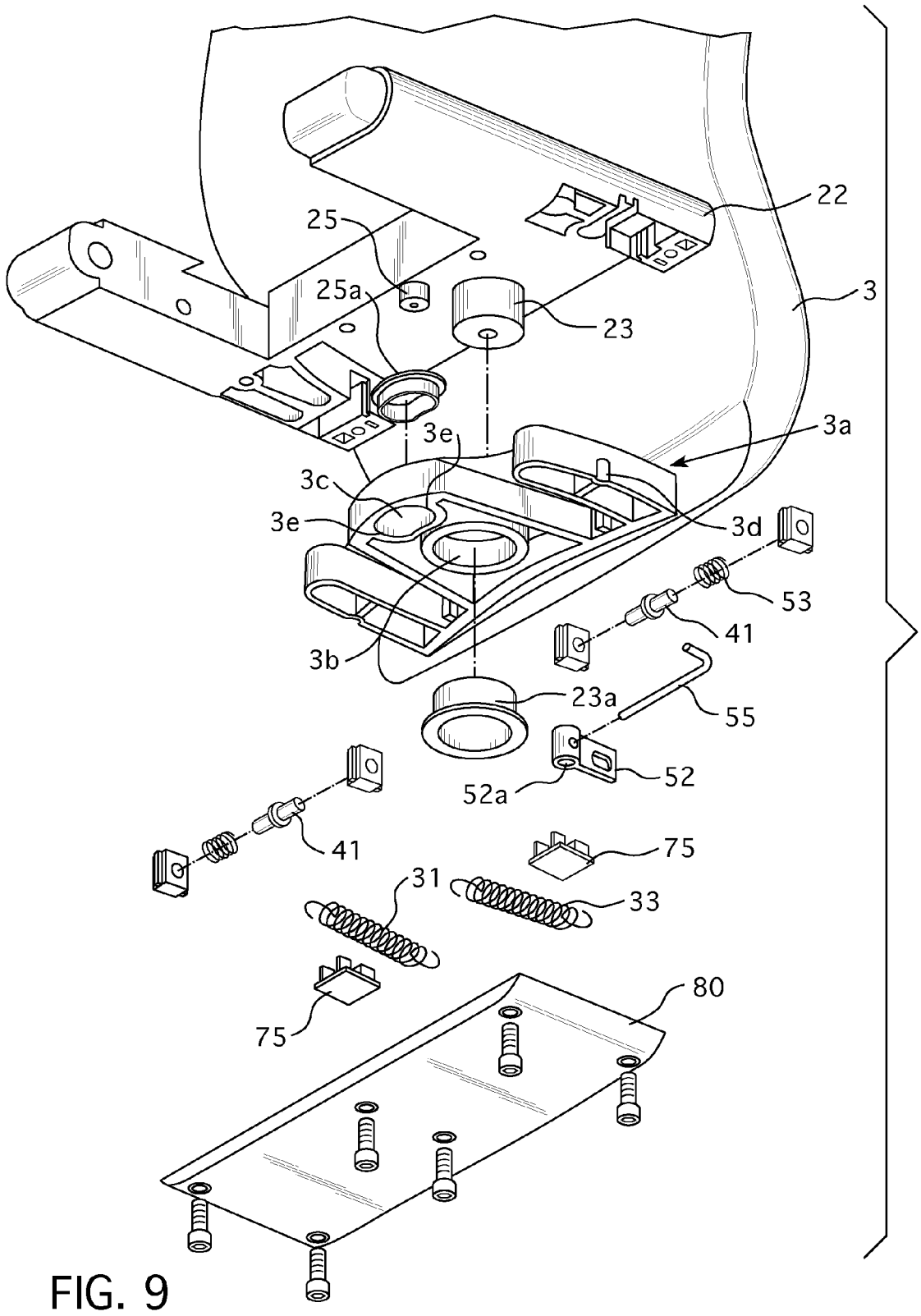
FIG. 9 is an exploded view of the first exemplary embodiment of the backrest swivel mechanism included in the first exemplary embodiment of the chair.

Referring to FIGS. 1-9, a chair 1 can include a seat 2 and a backrest 3, which may also be referred to as a chair back. The backrest 3 and seat 2 may be supported by a base 4. The chair may also include a backrest connection mechanism 21 that includes a backrest swivel mechanism 20. The backrest swivel mechanism can be configured to permit the backrest 3 to swivel relative to the seat 2. The base may include a height adjustable gas spring 4*a* or other height adjustment mechanism and may also include a floor contacting pedestal base 4*b*. The pedestal base 4*b* may include castors or wheels so that the chair is rollable along a floor. In alternative embodiments, the base 4 may include a plurality of chair legs that support the seat and backrest or other type of chair base that supports the seat 2 and backrest 3 on a floor. Armrests 11 may be attached to the base 4, a housing 12 attached to the base 4, a frame of the backrest 3, or a frame of the seat 2. The armrests 11 may be height adjustable or may be non-moving. The arm pads of the armrests 11 may also be configured to be moveable or stationary.

The backrest 3 may be configured to swivel relative to the seat 2 such that the backrest 3 rotates about a vertical axis or a substantially vertical axis (e.g. within 5° of being perfectly vertical) while the seat does not rotate or otherwise swivel. For example, the backrest 3 may be configured to rotate relative about a vertical axis 5 while the seat 2 does not rotate. The extent of rotation of the backrest may be any of a number of selectable ranges of rotation to meet a particular set of design criteria. For instance, the rotational swivel range of the backrest about the vertical axis 5 may range from +5° to −5° relative to a central non-swiveled position, from +10° to −10° relative to a central non-swiveled position, +15° to −15° relative to a central non-swiveled position, +20° to −20° relative to a central non-swiveled position, or from −45° to +45° relative to a central non-swiveled position.

The height adjustable gas spring 4*a* may include a top element that is positioned with an aperture 12*a* defined in a housing 12 or receptacle of a housing 12 to receive the gas spring 4*a* and attach the gas spring 4*a* to the housing 12 so that the seat 2 and backrest 3 are supported by the base 4. The housing 12 may be a seat frame assembly, or may be considered an upper element of the base 4 in some embodiments. In other embodiments, the housing may be the housing for a tilt mechanism of the chair.

A knockdown mechanism or height adjustment mechanism may be connected to the gas spring within the housing 12. A height adjustment mechanism can be connected to the gas spring 4*a* such that actuation of the height adjustment mechanism permits the height of the gas spring to be lowered or raised so that the height of the seat 2 and backrest can be lowered or raised. For instance, a handle may be moved so that a cable is pulled to actuate the gas spring for effecting height adjustment. The seat 2 and backrest 3 may each be lowered at the same time as the gas spring moves to a lower retracted position or a raised extended position for lowering or raising the height of the seat 2 and backrest 3.

The backrest 3 may be connected to the seat 2 or a housing 12 attached to the base 4 via a backrest connection mechanism 21. The backrest connection mechanism 21 may include a connection member 22 that is connected to the housing 12 such that the base 4 is able to support the backrest directly attached to the backrest connection mechanism 21. A first boss 23 and a second boss 25 can be connected to the connection member 22 or may be integral portions of the connection member 22 that are defined thereon. The first and second bosses 23 and 25 may each be structured as projections, knobs, studs, or other types of protuberances.

The connection member 22 is sized and configured for attachment to a bottom portion 3*a* of the backrest 3. The bottom portion 3*a* may define a plurality of apertures such as a first opening 3*b* sized to receive the first boss 23, a slot 3*c* sized to receive the second boss 25, and detent apertures 3*d* sized to receive moveable detents 41 for interlockable connections to the moveable detents 41. The interlockable connections that the bottom portion 3*a* of the backrest 3 may have when moveable detents are interlocked with the detent apertures 3*d* can be releaseable. For instance, the connection may be released such that the backrest is not interlocked with the detents 41 when the detents 41 are moved out of contact with, or interlock with, the structure of the bottom portion of the backrest 3*a* that defines the detent apertures 3*d*.

The first boss 23 may be centrally located below the rear of the seat 2 and define a vertical axis 5 about which the backrest 3 may be rotatable such that the backrest may be swivelable within a preselected, or predefined, swivel path of motion. The first boss 23 and the first opening 3*b* sized to receive the first boss can be generally cylindrical in shape or may be sized to have a generally circular or oval cross-sectional shape to facilitate the rotational motion about the axis of rotation defined by the first boss 23. The bottom portion 3*a* of the backrest 3 may rotate about the first boss 23.

In some embodiments, the bottom portion 3*a* of the backrest may be a bottom portion of the frame of the backrest 3. A back skin may be attached to the frame of the backrest and define a surface that a user's back may contact when sitting in the chair. The back skin may rotate when the frame of the backrest rotates due to rotation of the bottom portion 3*a* of the backrest 3 about the first boss 23.

That swivel path of rotation about which the backrest may rotate about the first boss 23 may be +/−10° or another preselected range of rotation relative to a centered, non-swiveled position. The swivel path may be defined by an elongated slot 3*c*. The slot 3*c* may extend from a left side to a right side of the seat such that the length of the slot 3*c* extends along an axis that is perpendicular to the axis 5 defined by the first boss 23. The shape of the slot 3*c* may be arcuate in configuration to define the path about which the backrest 3 is swivelable about the first boss 23. The second boss 25 is positioned within the slot 3*c* such that the slot is moveable about the arcuate path defined by the shape and length of the slot 3*c*. The terminal ends 3*e* of the slot are defined by the bottom portion 3*a* of the backrest and contact the second boss 25 to stop further swiveling of the backrest about the first boss 23. For instance, the bottom portion 3*a* of the backrest may rotate in a first direction (e.g. a clockwise direction) about the vertical axis 5 defined by the first boss 23 until the bottom portion 3*a* of the backrest that defines the first terminal end of the slot 3*c* contacts the second boss 25 positioned within the slot 3*c*. The backrest may also be rotatable about the first boss 23 in a second direction opposite the first direction (e.g. a counterclockwise direction) until the bottom portion 3*a* of the backrest 3 that defines the second terminal end of the slot 3*c* that is opposite the first terminal end of the slot contacts the second boss.

It should be appreciate that wear experienced by the bottom portion 3*a* of the backrest 3 and the first and second bosses 23 and 25 may be reduced by use of bushings or other wear lining elements. For instance, a first bushing 23*a* may be positioned around the first boss and be located between the first boss 23 and an inner sidewall of the bottom portion 3*a* of the backrest 3 that defines the first opening 3*b* to reduce wear experienced by the bottom portion 3*a* of the backrest 3 when it rotates about the first boss 23. A wear reducing liner 25*a* may also be positioned along the inner sidewall of the bottom portion 3*a* of the backrest 3 that defines the slot 3*c*. The wear reducing liner 25*a* and first bushing 23*a* may each be composed of a polymeric material configured to reduce wear or friction that may be incurred by rotation of the bottom portion of the backrest about the first boss and movement of the sidewall defining slot 3*c* about the second boss 25 positioned within the slot 3*c*. A second bushing could also be positioned around the second boss 25 to help reduce wear that could be experienced by the second boss 25 contacting with the inner sidewall of the bottom portion of 3*a* of the backrest 3.

First and second springs 31 and 33 may also be included in the backrest connection mechanism to bias the backrest to a centered, non-swiveled position while also providing a force that a user must act against to effect swiveling of the backrest so that such swiveling can occur in a relatively smooth fashion to provide a smooth swiveling ride along the path of rotation of the backrest 3 as the backrest swivels. The first and second springs 31 and 33 may therefore help provide a smooth ride to the swiveling of the backrest 3.

The first and second springs 31 and 33 can be coil springs, elongated resilient elastomeric members, or other spring elements that provide a biasing force to bias the backrest toward the connection member 22. The first spring 31 may be positioned adjacent a left side of the seat 2 under the seat 2 and have a first front end attached to the connection member 22 and a second rear end that is opposite the first front end attached to the bottom portion 3*a* of the backrest. The second spring 33 may be positioned adjacent the right side of the seat 2 under the seat 2 and have a first front end attached to the connection member 22 and a second rear end that is opposite the first front end attached to the bottom portion 3*a* of the backrest. The first and second springs 31 and 33 may be attached to the connection member 22 and bottom portion 3*a* of the backrest 3 in any of a number of suitable ways. For instance, the first front ends of the first and second springs 31 and 33 may be interlocked with hooks, prongs, or other fastener elements defined in the connection member 22 for attaching the first ends to the connection members 22 (e.g. a hook or prong of the spring is interlockingly retained within a loop defined in the connection member 22, a hook or prong defined in the connection member 22 is interlockingly retained within a loop or ring attached to an end of a spring, etc.). Alternatively the first front ends of the first and second springs 31 and 33 may be attached to the connection member 22 via other fastening mechanisms such as a bolt, screw, fastener, weld, or other fastening mechanism. The second rear ends of the first and second springs may be connected to the bottom portion 3*a* of the backrest 3 via any type of fastening mechanism such as a bolt, screw, other type of fastener, a weld, or by having the second rear ends in interlocked mating contact or interlocked engagement with hooks, prongs, or other fastening profiles defined in the bottom portion 3*a* of the backrest 3 (e.g. a hook or prong of the spring is interlockingly retained within a loop defined in the bottom portion 3*a* of the backrest 3, a hook or prong defined in the bottom portion 3*a* of the backrest 3 is interlockingly retained within a loop or ring attached to an end of a spring, etc.). The first and second springs 31 and 33 may be spaced apart from each other such that the first boss 23 and the second boss 25 are each located between the first and second springs 31 and 33.

When the backrest 3 is swiveled in the first direction to a first swiveled position, the second spring 33 may be extended as the bottom portion of the backrest rotates about the vertical axis 5 defined by the first boss 23. The first spring 31 may retract when the second spring is extended during rotation of the backrest to the first swiveled position. When the backrest 3 is swiveled in the second direction to the second swiveled position, the second spring may be retracted and the first spring may be extended. When a user no longer provides a force against the backrest 3 to effect swiveling, the first and second springs 31 and 33 drive motion of the backrest to the centered, non-swiveled position due to the first and second springs' positioning and attachment to the connection member 22 and the bottom portion 3*a* of the backrest 3.

A cover 80 may be attached to the connection member 22 to cover the first and second springs 31 and 33, first and second bosses 23 and 25, and bottom portion 3*a* of the backrest connected to the connection member 22 via at least the first and second bosses being positioned within the first opening 3*b* and slot 3*c*. The cover 80 may provide a safety function by preventing a user from having his or her finger getting caught in the components of the chair back swivel mechanism 20. Additionally, wear resistant sliders 75 may be attached to the bottom portion 3*a* of the backrest to be positioned between the bottom portion 3*a* of the backrest 3 and the cover 80. The sliders 75 may not move relative to the backrest 3, but may contact the cover 80 and rub against a top of the cover to reduce wear that would otherwise be experienced by the bottom portion 3*a* of the backrest 3 when the backrest 3 is swiveled.

Other portions of the bottom portion 3*a* of the backrest may also be configured to matingly interlock with portions of the connection member 22. Fasteners, welding, or other type of fastening mechanism may also be utilized to connect the bottom portion 3*a* of the backrest to the connection member 22.

A locking device 51 may be attached to the backrest connection mechanism 21. The locking device may be configured to lock and unlock swiveling of the backrest 3 about the vertical axis 5 defined by the first boss 23 that may be provided by the backrest connection mechanism 21. The locking device 51 may be actuated from a locked position in which swiveling of the backrest is prevented, to an unlocked position in which swiveling of the backrest is allowed.

The locking device 51 can be attached to the connection member 22 and can be configured to be moved from a locking position to an unlocking position. For instance, the locking device 51 can include a moveable detent member 41 that is moved from an extended locking position to a retracted unlocked position. The detent 41 may be sized and shaped to extend into a detent recess 3*d* formed in the bottom portion 3*a* of the backrest 3 or otherwise defined in the bottom portion 3*a* of the backrest 3. The detent recess 3*d* may be sized and shaped so that the detent 41 interlocks with the bottom portion 3*a* of the backrest 3 that defines the detent recess 3*d* to prevent swiveling of the backrest 3. When the detent 41 is moved out of the detent recess 3*d* to an unlocked position, the backrest 3 may be free to swivel. The detent 41 may be a pin, dog, or other element sized and configured for interlocking contact with a portion of the backrest 3 that defines the detent recess 3*d* to prevent the backrest 3 from being rotatable about the vertical axis 5.

The moveable detent 41 may be moved via a handle 55 that is coupled to a detent moving member 52 so that a user may manipulate the handle 55 to move the handle from a locking position to an unlocking position. Movement of the handle 55 can cause the detent moving member 52 to rotate about a pivot point 61 defined by the connection member 22 to an unlocking position via the connection between the handle 55 and the detent moving member 52. Movement of the detent moving member 52 to the unlocking position can cause the detent 41 to move from a locking position to the unlocked position. For instance, the detent 41 may pass through a hole in the detent moving member 52. A portion of the detent moving member 52 may contact a ledge or portion of the detent 41 so that movement of the detent moving member 52 to the unlocked position results in the detent moving member 52 contacting the detent 41 and driving the detent 4*l* away from the bottom portion 3*a* of the backrest to its retracted unlocked position For example, a portion of the detent can be sized to pass through the hole in the detent moving member and a second portion from which the first portion extends can have a larger width or diameter (e.g. be thicker) and contact or otherwise engage the moving member 52 adjacent the hole 52*a* in the moving member 52 so that motion of the moving member 52 is able to help actuate motion of the detent 41.

A spring 53 may be in contact with the moveable detent 41 to bias the detent 41 toward the bottom portion 3*a* of the backrest to bias the detent 41 to the extended locking position of the detent 41. For example, the spring 53 can contact or otherwise engage a first side of the second portion of the detent 41 that is wider or thicker than the portion of the detent that passes through the hole in the detent moving member 52. The detent moving member 52 may contact or otherwise engage a second side of this second portion of the detent that is opposite the first side on which the spring contacts or engages. Movement of the detent 41 to the unlocked position may cause the spring 52 to retract. When the detent moving member 52 is moved to an unlocking position, the detent 41 may be free to pass through the hole in the detent moving member 52 and move to the locking position. The spring 53 may drive this motion of the detent 41 through the hole in the detent moving member 52 via extension of the spring 53.

To effect movement of the detent 41 from the unlocked retracted position to the locking extended position, the handle 55 may be moved from the unlocked position to the locking position. Movement of the handle 55 can cause the detent moving member 52 to move about the pivot point 61 to an unlocking position in which the detent 41 is free to move through the hole of the detent moving member 52 so that the detent 41 is able to move to its extended locking position. The spring 53 may extend to drive the movement of the detent 41 when the detent moving member 52 is in the unlocked position.

The spring 53 may be an elastomeric body, a resilient body, a coil spring or other type of spring element that is configured to bias the detent 41 to the extended locking position. The spring may be configured so that it is positioned between the connection member 22 and a portion of the moveable detent 41 such that the spring 53 contacts the detent 41 to drive movement of the detent to the extended locking position. One end of the spring 53 may be in contact with a portion of the connection member 22 and an opposite end of the spring 53 may be in contact with a portion of the detent 41 to drive movement of the detent 41 and bias the detent 41 to the extended, locking position. A portion of the detent 41 may be positioned between the end of the spring 53 that is in contact with the detent 41 and an end of the detent moving member 52 that is contactable with the detent 41 to drive movement of the detent 41 to the retracted, unlocked position.

In alternative embodiments, the handle 55 may be a movement member that is coupled to an actuator. A user may manipulate the actuator to drive movement of the handle 55 to effect the movement of the detent from the locking position to the unlocking position and vice versa. Such an actuator may include a button, flipper, or other actuator element that is coupled to the moveable member via a wire, cable, coupling element.

The locking device 51 may only be on one side of the bottom portion 3*a* of the backrest 3 to lock and unlock the swiveling of the backrest 3. The locking device 51 could also be considered a locking mechanism or a swivel resistance mechanism. In alternative embodiments, the locking device 51 may include multiple moveable detents 41. One moveable detent may be on a right side of the bottom portion 3*a* of the backrest to interlock with a detent recess and a second detent may be on a left of the bottom portion 3*a* of the backrest 3 to interlock with a detent recess on that side of the backrest 3. The detents 41 may both be moveable from locking to unlocking positions (and vice versa) and actuation of movement of both detents may be driven via movement of only one actuator such as handle 55 or other actuator element connected to such a handle. In other embodiments having multiple detents 41 and springs 53 connected to respective detents, the handle 55 can be connected to only one detent moving member 52 to move one of the detents 41 from a locked position to an unlocked position. By moving only one of the multiple detents, the locking of the swiveling of the backrest may be unlocked based on the force exerted by the other remaining detent 41 being configured to be unable to prevent swiveling of the backrest without the other detent 41 being engaged within its respective recess 3*d*.

It should be appreciated that different variations to the exemplary embodiments of the chair and chair back swivel mechanism can be made to meet different sets of design criteria. For instance, the backrest swivel mechanism 20 can be structured so that the first boss 21 is received within a first opening of a portion of the seat (e.g. a portion of a seat frame) or a portion of the base (e.g. a portion of a tilt mechanism housing). For such embodiments, the second boss 25 can be received within a slot 3*c* defined in the portion of the seat or the portion of the base where the slot is elongated and arcuate in shape to define a path of rotation of the backrest about the first vertical axis between a first swivel position and a second swivel position. The second boss 25 can contact or otherwise engage structure adjacent a first end of the slot when the backrest is swiveled to the first swiveled position and the second boss 25 can contact or otherwise engage structure adjacent a second end of the slot when the backrest is swiveled to the second swiveled position. Such embodiments of the backrest swivel mechanism 20 can also include a locking device 51. The bottom portion of the backrest, the portion of the seat, or the portion of the base can have both the opening 3*b* for receiving the first boss 21 and the slot 3*c* for receiving the second boss 25. In yet other embodiments, the bottom portion of the backrest can have only one of the opening 3*b* for receiving the first boss 21 and the slot 3*c* for receiving the second boss 25. For those embodiments, the portion of the seat or the portion of the base can have the other one of the opening for the first boss 23 and the slot for receiving the second boss 25. The portion of the seat 2 having at least one of the opening 3*b* and slot 3*c* for receiving the first and second bosses 23 and 25 can be a portion of the seat frame. The portion of the base having at least one of the opening 3*b* and slot 3*c* for receiving the first and second bosses 23 and 25 can be a portion of a housing of the base for a tilt mechanism, knock down mechanism, or for receiving a portion of a gas spring. In other embodiments, the portion of the base having at least one of the opening 3*b* and slot 3*c* for receiving the first and second bosses 23 and 25 can be a housing or connection structure that is configured to facilitate connection of the backrest 3 to the base 4 and/or the seat 2 for being supported by legs, a pedestal, a stand, or other support structure configured to support the chair on a floor.

As another example, in some embodiments, the backrest may rotate about only a single boss while in other embodiments the backrest may swivel about multiple different bosses. As another example, the range of swiveling that is provided so that the backrest is rotatable about at least one vertical axis relative to a seat is any range found to be desirable to meet a particular design objective. Typically, a rear end of the seat may limit the extent to which the back swiveling range may be, but in some chair configurations it is possible that this may not be the case. As another example, the backrest of a chair may have any of a number of suitable configurations to meet a set of design criteria. The backrest may be upholstered, may include cushioning covered by a fabric or leather cover, or may include a back skin that is composed of a polymeric material and is attached to a back frame for directly contacting the back of a seated user. The shape and sizes of back frames of the backrests may also be any of a number of suitable shapes and sizes.

As yet other examples, embodiments of the chair may include a type of chair tilt mechanism that helps control or provide for tilting of the seat or backrest. In some embodiments, such a mechanism can be configured to permit the backrest and seat to both tilt about a horizontal axis to recline rearwardly in response to a user pushing back on the backrest to recline the chair. The seat and back rest may tilt to the reclined position at the same time, or synchronously in such embodiments.

As yet another example, it is also contemplated that the seat may be configured to rotate. For instance, the seat may be connected to the base to rotate about a vertical axis. The seat 2 may be configured to swivel independent of the backrest such that the seat 2 can swivel while the backrest does not swivel. It is also contemplated that the seat swivel mechanism can be configured to permit the seat to swivel while the backrest is swiveled. For such embodiments, the seat 2 may swivel synchronously with the backrest, the seat may swivel at the same time of the backrest but to a different degree as compared to the backrest or the seat may swivel independent of the backrest 3.

As yet another example, embodiments of the chair may include any type of armrest design to meet a particular set of design criteria. Some embodiments of the chair may also be configured to not include armrests.

Therefore, it should be understood that while certain exemplary embodiments of chairs and backrest swivel mechanisms for chairs and methods of making and using the same have been discussed and illustrated herein, it is to be distinctly understood that the invention is not limited thereto but may be otherwise variously embodied and practiced within the scope of the following claims.

What is claimed is:

1. A chair comprising:

a seat;

a base that supports the seat;

a backrest, the backrest connected to at least one of the base and the seat via a backrest connection mechanism, the backrest connection mechanism comprising a backrest swivel mechanism that facilitates swiveling of the backrest relative to the seat such that the backrest is rotatable about at least one vertical axis from a centered position to a plurality of swiveled positions;

wherein the swiveled positions comprise a first swivel position and a second swivel position, the backrest being in the first swivel position after being rotated toward a first side of the chair about the at least one vertical axis by at least 5°, the backrest being in the second swivel position after being rotated toward a second side of the chair that is opposite the first side of the chair about the at least one vertical axis by at least 5°;

wherein the backrest swivel mechanism comprises:

a first boss that is received within an opening of a bottom portion of the backrest;

a second boss that is received within a slot of the bottom portion of the backrest, the slot being elongated and arcuate in shape to define a path of rotation of the backrest about the first vertical axis between the first swivel position and the second swivel position;

the at least one vertical axis comprising a first vertical axis, the first boss defining the first vertical axis; and wherein the second boss engages a portion of the bottom portion of the backrest adjacent a first end of the slot when the backrest is swiveled to the first swiveled position about the first vertical axis and wherein the second boss engages a portion of the bottom portion of the backrest adjacent a second end of the slot when the backrest is swiveled to the second swiveled position, the second end of the slot being opposite the first end of the slot.

2. A chair comprising:

a seat;

a base that supports the seat;

a backrest, the backrest connected to at least one of the base and the seat via a backrest connection mechanism, the backrest connection mechanism comprising a backrest swivel mechanism that facilitates swiveling of the backrest relative to the seat such that the backrest is rotatable about at least one vertical axis from a centered position to a plurality of swiveled positions;

wherein the swiveled positions comprise a first swivel position and a second swivel position, the backrest being in the first swivel position after being rotated toward a first side of the chair about the at least one vertical axis by at least 5°, the backrest being in the second swivel position after being rotated toward a second side of the chair that is opposite the first side of the chair about the at least one vertical axis by at least 5°;

wherein the backrest swivel mechanism comprises:

a first boss that is received within an opening of a bottom portion of the backrest;

a second boss that is received within a slot of the bottom portion of the backrest, the slot being elongated and arcuate in shape to define a path of rotation of the backrest about the first vertical axis between the first swivel position and the second swivel position;

the at least one vertical axis comprising a first vertical axis, the first boss defining the first vertical axis; and a locking device connected to the backrest swivel mechanism, the locking device moveable from a locking position that prevents swiveling of the backrest to an unlocked position, the backrest being swivelable relative to the seat when the locking device is in the unlocked position.

3. The chair of claim 2 wherein the path of rotation defined by the slot limits swiveling of the backrest relative to the seat about the first vertical axis to +/−40°, +/−20° or +/−10° relative to a centered position of the backrest.

4. The chair of claim 2 wherein the second boss engages a portion of the bottom portion of the backrest adjacent a first end of the slot when the backrest is swiveled to the first swiveled position about the first vertical axis and wherein the second boss engages a portion of the bottom portion of the backrest adjacent a second end of the slot when the backrest is swiveled to the second swiveled position, the second end of the slot being opposite the first end of the slot.

5. A chair comprising:

a seat;

a base that supports the seat;

a backrest, the backrest connected to at least one of the base and the seat via a backrest connection mechanism, the backrest connection mechanism comprising a backrest swivel mechanism that facilitates swiveling of the backrest relative to the seat such that the backrest is rotatable about at least one vertical axis from a centered position to a plurality of swiveled positions;

wherein the swiveled positions comprise a first swivel position and a second swivel position, the backrest being in the first swivel position after being rotated toward a first side of the chair about the at least one vertical axis by at least 5°, the backrest being in the second swivel position after being rotated toward a second side of the chair that is opposite the first side of the chair about the at least one vertical axis by at least 5°;

wherein the backrest swivel mechanism comprises:

a first boss that is received within an opening of a bottom portion of the backrest;

a second boss that is received within a slot of the bottom portion of the backrest;

the at least one vertical axis comprising a first vertical axis, the first boss defining the first vertical axis;

a first spring having a first end attached to a connection member of the backrest swivel mechanism and a second end attached to the bottom portion of the backrest; and a second spring having a first end attached to the connection member and a second end attached to the bottom portion of the backrest; and the first boss being attached to the connection member and being positioned between the first and second springs.

6. The chair of claim 5 wherein the second boss is also attached to the connection member and is also positioned between the first and second springs; and wherein the connection member is attached to at least one of the seat and the base.

7. The chair of claim 6 further comprising:

a locking device connected to the backrest swivel mechanism, the locking device moveable from a locking position that prevents swiveling of the backrest to an unlocked position, the backrest being swivelable relative to the seat when the locking device is in the unlocked position.

8. The chair of claim 7 wherein the locking device comprises:

a detent that is moveable from an extended locking position to a retracted unlocked position, the detent being positioned within a recess of the bottom portion of the backrest to engage the bottom portion of the backrest and prevent swiveling of the backrest when in the extended locking position, the detent being retracted out of the recess of the bottom portion of the backrest when in the retracted unlocked position.

9. The chair of claim 8 wherein the locking device also comprises:

a detent moving member having a hole, a portion of the detent passing through the hole of the detent moving member; and a spring, the spring engaging the detent to bias the detent to the extended locking position.

10. The chair of claim 9 wherein the detent moving member contacts a portion of the detent to drive movement of the detent from the extended locking position to the retracted unlocked position when the locking device is moved to the unlocked position; and wherein the spring drives movement of the detent through the hole of the detent moving member to the extended locking position when the locking device is moved to the locking position.

11. The chair of claim 10 wherein the detent moving member is moveable about a pivot point from a first position to a second position, the detent moving member retracting the detent to the retracted unlocked position when the detent moving member is moved to the second position.

12. A chair comprising:

a seat;

a base that supports the seat;

a backrest, the backrest connected to at least one of the base and the seat via a backrest connection mechanism, the backrest connection mechanism comprising a backrest swivel mechanism that facilitates swiveling of the backrest relative to the seat such that the backrest is rotatable about at least one vertical axis from a centered position to a plurality of swiveled positions;

wherein the swiveled positions comprise a first swivel position and a second swivel position, the backrest being in the first swivel position after being rotated toward a first side of the chair about the at least one vertical axis by at least 5°, the backrest being in the second swivel position after being rotated toward a second side of the chair that is opposite the first side of the chair about the at least one vertical axis by at least 5°;

wherein the backrest swivel mechanism comprises:

a first boss that is received within an opening of a bottom portion of the backrest;

a second boss that is received within a slot of the bottom portion of the backrest;

the at least one vertical axis comprising a first vertical axis, the first boss defining the first vertical axis;

the second boss engaging a portion of the bottom portion of the backrest adjacent a first end of the slot when the backrest is swiveled to the first swiveled position about the first vertical axis and wherein the second boss engaging a portion of the bottom portion of the backrest adjacent a second end of the slot when the backrest is swiveled to the second swiveled position, the second end of the slot being opposite the first end of the slot;

a first spring having a first end attached to a connection member of the backrest swivel mechanism and a second end attached to the bottom portion of the backrest; and a second spring having a first end attached to the connection member and a second end attached to the bottom portion of the backrest; and the first boss being attached to the connection member and being positioned between the first and second springs.

13. A chair comprising:

a seat;

a base that supports the seat;

a backrest, the backrest connected to at least one of the base and the seat via a backrest connection mechanism, the backrest connection mechanism comprising a backrest swivel mechanism that facilitates swiveling of the backrest relative to the seat such that the backrest is rotatable about at least one vertical axis from a centered position to a plurality of swiveled positions;

wherein the swiveled positions comprise a first swivel position and a second swivel position, the backrest being in the first swivel position after being rotated toward a first side of the chair about the at least one vertical axis by at least 5°, the backrest being in the second swivel position after being rotated toward a second side of the chair that is opposite the first side of the chair about the at least one vertical axis by at least 5°;

wherein the backrest swivel mechanism comprises:

a first boss that is received within an opening of a bottom portion of the backrest;

a second boss that is received within a slot of the bottom portion of the backrest;

the at least one vertical axis comprising a first vertical axis, the first boss defining the first vertical axis;

a locking device connected to the backrest swivel mechanism, the locking device moveable from a locking position that prevents swiveling of the backrest to an unlocked position, the backrest being swivelable relative to the seat when the locking device is in the unlocked position.

14. The chair of claim 13 wherein the chair has a front and a rear and the first and second sides of the chair are left and right sides of the chair.

15. The chair of claim 13 wherein the backrest is comprised of a frame, and the bottom portion of the backrest is the bottom portion of the frame of the backrest.

16. The chair of claim 13 wherein the slot is elongated and arcuate in shape to define a path of rotation of the backrest about the first vertical axis between the first swivel position and the second swivel position.

17. The chair of claim 13 wherein the path of rotation defined by the slot limits swiveling of the backrest relative to the seat about the first vertical axis to +/−40°, +/−20° or +/−10° relative to a centered position of the backrest.

18. The chair of claim 13 wherein the backrest swivel mechanism also comprises:

a first spring having a first end attached to a connection member of the backrest swivel mechanism and a second end attached to the bottom portion of the backrest; and a second spring having a first end attached to the connection member and a second end attached to the bottom portion of the backrest; and the first boss being attached to the connection member and being positioned between the first and second springs.

19. The chair of claim 13, wherein a length of the slot extends along an axis that is perpendicular to the first vertical axis.

* * * * *